US010619442B2

(12) United States Patent
Arteaga

(10) Patent No.: US 10,619,442 B2
(45) Date of Patent: Apr. 14, 2020

(54) BLOWOUT PREVENTERS WITH PRESSURE-BALANCED OPERATING SHAFTS

(71) Applicant: Cameron International Corporation, Houston, TX (US)

(72) Inventor: Nicolas Arteaga, Jersey Village, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 15/827,170

(22) Filed: Nov. 30, 2017

(65) Prior Publication Data

US 2019/0162039 A1 May 30, 2019

(51) Int. Cl.
*E21B 33/06* (2006.01)

(52) U.S. Cl.
CPC ..... *E21B 33/062* (2013.01)

(58) Field of Classification Search
CPC ..... E21B 33/06; E21B 33/064
See application file for complete search history.

(56) References Cited

U.S. PATENT DOCUMENTS 3,739,845 A * 6/1973 Berry ..... E21B 34/16 137/71
5,735,502 A 4/1998 Levett et al.
6,719,262 B2 * 4/2004 Whitby ..... E21B 33/062 166/85.4
7,300,033 B1 * 11/2007 Whitby ..... E21B 33/062 166/85.4
7,338,027 B1 * 3/2008 Whitby ..... E21B 33/062 166/85.4
7,374,146 B2 * 5/2008 Whitby ..... E21B 33/062 166/85.4
9,970,569 B2 * 5/2018 Kotrla ..... E21B 33/062
2002/0104662 A1 * 8/2002 Dallas ..... E21B 19/22 166/384
2003/0024705 A1 * 2/2003 Whitby ..... E21B 33/064 166/363
2010/0319906 A1 * 12/2010 Van Winkle ..... E21B 33/063 166/85.4
2011/0140013 A1 * 6/2011 Guo ..... E21B 33/062 251/1.3
2013/0126763 A1 * 5/2013 Guo ..... E21B 33/062 251/1.3
2013/0313449 A1 * 11/2013 Weir ..... E21B 33/062 251/1.3
2017/0130575 A1 * 5/2017 Jaffrey ..... E21B 33/06
2017/0362911 A1 * 12/2017 Read ..... E21B 33/063
2018/0283126 A1 * 10/2018 Haverstad ..... E21B 33/062
2018/0347710 A1 * 12/2018 Whitby ..... F16K 5/0605

* cited by examiner

*Primary Examiner* — Anna M Momper
*Assistant Examiner* — Aaron L Lembo
(74) *Attorney, Agent, or Firm* — Helene Raybaud

(57) ABSTRACT

Blowout preventers with pressure-balanced operating shafts are provided. In one embodiment, a blowout preventer includes a hollow body having a bore and a ram cavity. The blowout preventer also includes a pair of opposing rams disposed in the ram cavity and a shaft that extends through both rams of the pair of opposing rams. Additional systems, devices, and methods are also disclosed.

16 Claims, 13 Drawing Sheets

BLOWOUT PREVENTERS WITH PRESSURE-BALANCED OPERATING SHAFTS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Further, such systems generally include a wellhead assembly through which the resource is accessed or extracted. These wellhead assemblies may include a wide variety of components, such as various casings, valves, fluid conduits, and the like, that control drilling or production operations. More particularly, wellhead assemblies often include blowout preventers, such as a ram-type preventer that uses one or more pairs of opposing rams to restrict flow of fluid through the blowout preventer or to shear through a drill string or another object within the blowout preventer. Various tools can be run into wells through the wellhead assemblies for formation evaluation or sampling. In some instances, such tools are lowered into wells by cables (e.g., wirelines or slicklines) and blowout preventers of the wellhead assemblies are used as wireline valves to seal about the cables.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to blowout preventers having pressure-balanced operating shafts. In certain embodiments, a ram-type blowout preventer includes multiple actuation shafts that extend through opposing rams and through opposite ends of a pressure-containing body housing the opposing rams. With the ends of these actuation shafts outside the pressure-containing body, wellbore pressure within the body does not generate a retraction force on ends of the actuation shafts that would oppose closing motion of the rams. This can reduce the operating force needed to move the rams to a closed position within the body.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
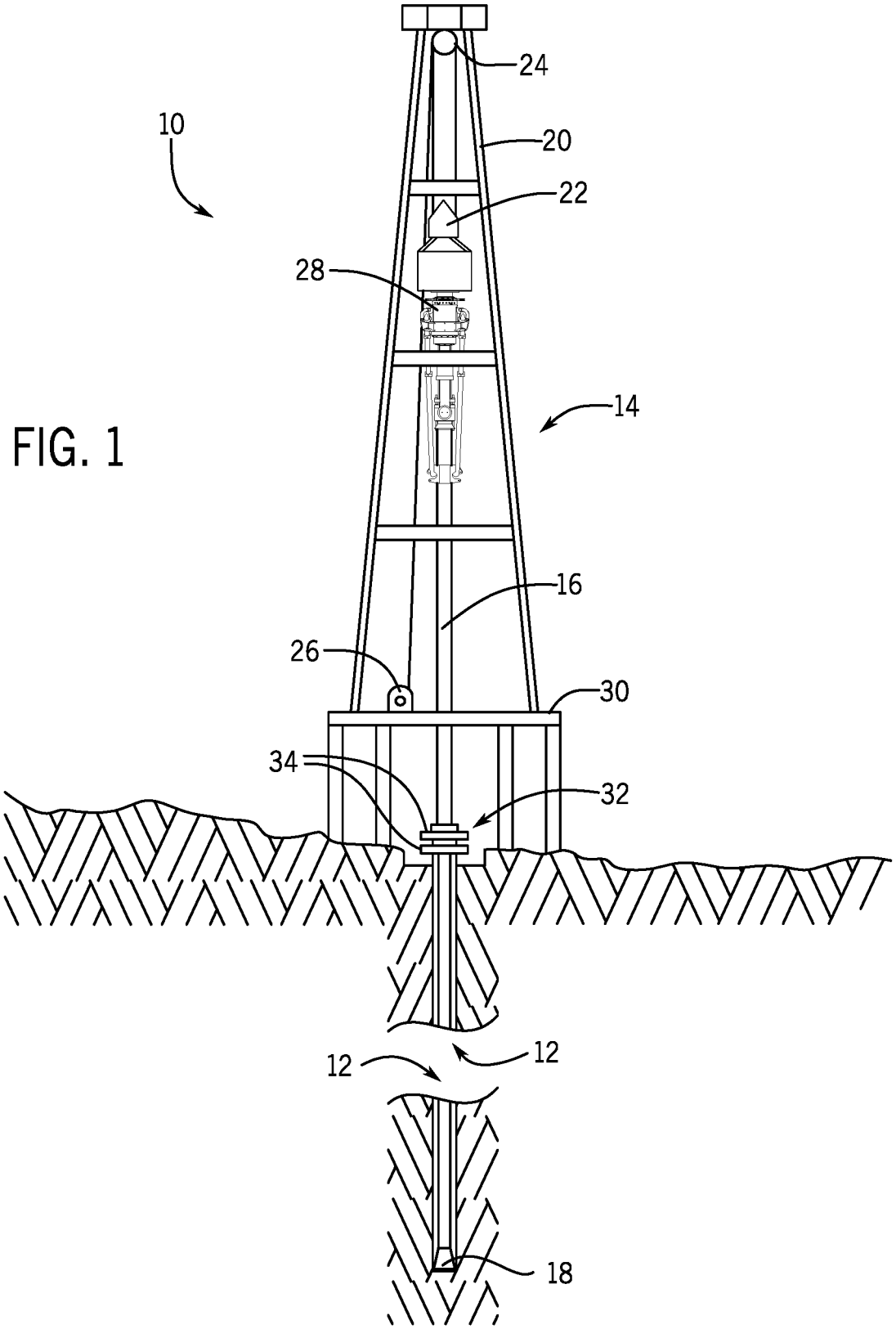
FIG. 1 generally depicts a drilling system having wellhead equipment including a blowout preventer in accordance with one embodiment of the present disclosure.

Turning now to the drawings, a drilling apparatus 10 including a blowout preventer is illustrated in FIG. 1 in accordance with one embodiment. Notably, the system 10 may be operated to drill a well 12 to access a subterranean resource, such as oil or natural gas. As depicted, the apparatus 10 includes an onshore drilling rig 14, although the apparatus 10 could instead be an offshore system in other embodiments. The drilling rig 14 uses a drill string 16 and a drill bit 18 to form the well 12.

The drilling rig 14 also includes a mast 20 and a hoisting system (presently shown as including a traveling block 22, a crown block 24, and a winch 26) to enable a top drive 28 to be raised and lowered with respect to a drill floor 30. The drill string 16 is suspended from the top drive 28, and extends through a hole in the drill floor 30 and through a wellhead assembly 32 having a wellhead and at least one blowout preventer 34 mounted over the wellhead. The drill string 16 can be rotated by the top drive 28 and can be raised and lowered with the top drive 28 (via the traveling block 22) to facilitate drilling operations. Although the drilling apparatus 10 is depicted as including the top drive 28, some other embodiments do not include a top drive, such as embodiments using a kelly and a rotary table for rotating the drill string 16.

Subterranean formations penetrated by the well 12 can be evaluated for various purposes, including for identifying hydrocarbon reservoirs within the formations. During drilling operations, one or more drilling tools in the drill string 16 may be used to test or sample the formations. Following removal of the drill string 16, a wireline tool may be run into the well to test or sample the formations. These drilling tools and wireline tools, as well as other wellbore tools conveyed on coiled tubing, slickline, drill pipe, casing, or other means of conveyance, are also referred to herein as "downhole tools." A downhole tool may be employed alone or in combination with other downhole tools in a downhole tool string.

The measurements taken by downhole tools may be used, for example, to determine downhole conditions or to identify characteristics of formations surrounding boreholes in which the downhole tools are deployed. Some downhole tools include sensors for measuring downhole parameters, such as temperature, pressure, viscosity, resistivity, and the like. Downhole tools can also include various imaging devices and logging devices. The measurements acquired via such downhole tools may be useful in assessing downhole conditions, understanding formation characteristics, and directing oilfield operations.

Figure 2:
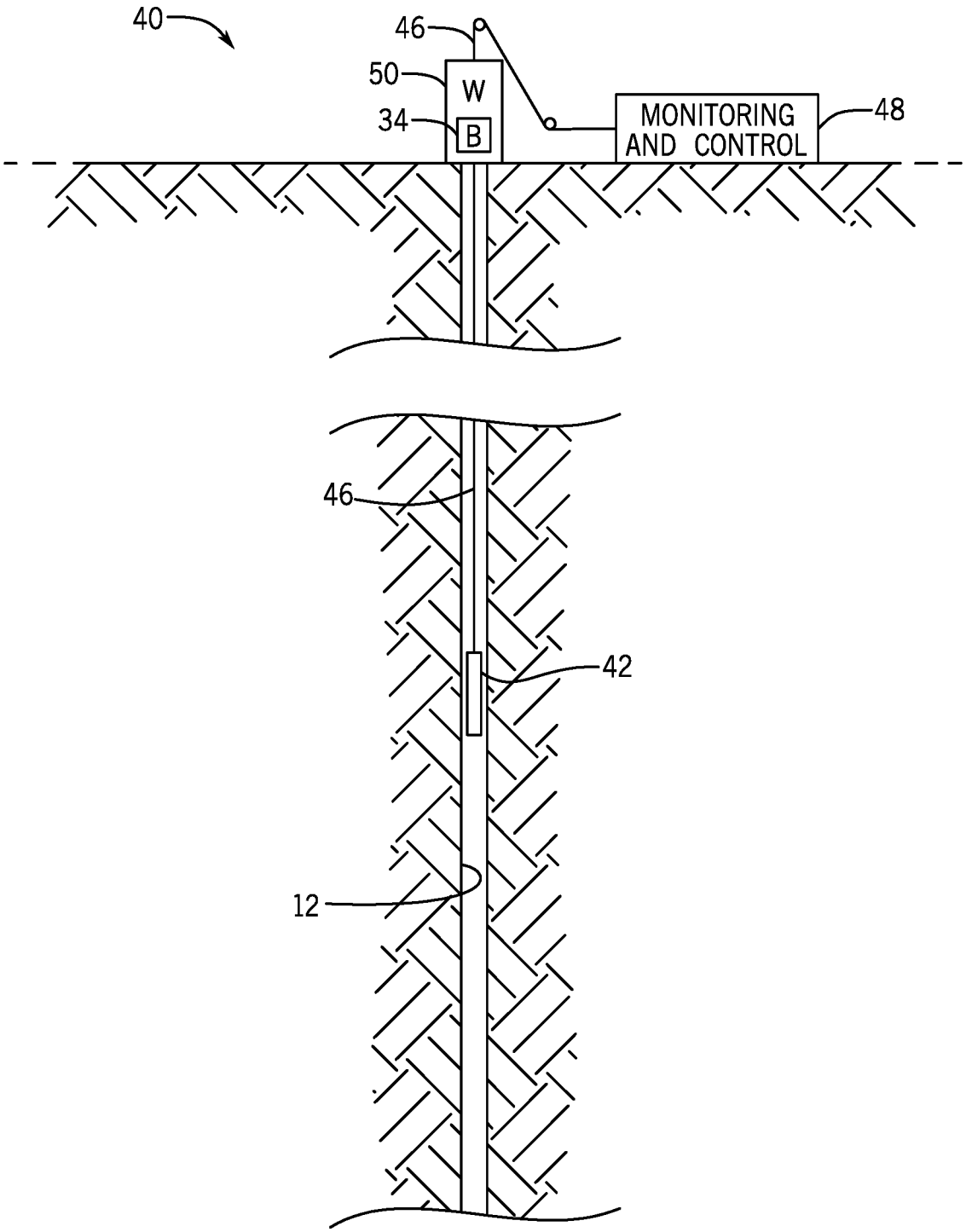
FIG. 2 generally depicts an apparatus including a downhole tool deployed within a well on a cable through wellhead equipment including a blowout preventer used as a wireline valve in accordance with one embodiment.

An apparatus 40 for measuring downhole parameters in the well 12 is depicted in FIG. 2 in accordance with one embodiment. In this depicted embodiment, a downhole tool 42 is suspended in the well 12 on a cable 46. The downhole tool 42 could be deployed in the well 12 as a single tool or as multiple tools coupled together in a tool string. The cable 46 may be a wireline cable with at least one conductor that enables data transmission between the downhole tool 42 and a monitoring and control system 48. In some other embodiments, the cable 46 is a slickline. The downhole tool 42 may be raised and lowered within the well 12 (which may also be referred to as a borehole) via the cable 46 in any suitable manner. For instance, the cable 46 can be reeled from a drum in a service truck, which may be a logging truck having the monitoring and control system 48. Although the downhole tool 42 is depicted in FIG. 2 as being deployed via a cable, the downhole tool 42 could be deployed within the well 12 in any other suitable manner. Further, while the apparatus 40 is shown in FIG. 2 at an onshore well 14, the apparatus 40 could be used with an offshore well in full accordance with the present techniques.

The monitoring and control system 48 controls movement of the downhole tool 42 within the well 12 and receives data from the downhole tool 42. The monitoring and control system 48 can include one or more computer systems or devices. The system 48 can receive data from the downhole tool 42, and this data can be stored, communicated to an operator, or processed. Although generally depicted in FIG. 2 at a wellsite, it is noted that the system 48 could be positioned elsewhere, and that the system 48 could be a distributed system with elements provided at different places near or remote from the well 12. For example, a local component of the system 48 may be located at the wellsite for controlling operation of the downhole tool 42 and receiving data from the tool 42, but the received data could be processed by a different portion of the system 48 at another location.

The downhole tool 42 can be lowered via the cable 46 into the well 12 through a wellhead assembly 50. By way of example, the wellhead assembly 50 is depicted in FIG. 2 as including a blowout preventer 34, which can be mounted over a wellhead of the well 12 as a wireline valve. In such an application, the blowout preventer 34 can be closed to seal about the cable 46 to control flow from the well 12 through the blowout preventer 34. But the wellhead assembly 50 can also or instead include other components, such as a lubricator and a grease head to name just two examples. These other components can be assembled together with the blowout preventer 34 into a stack assembly, which may be mounted over the wellhead and may also be referred to as a pressure-control string.

The blowout preventer 34 can take the form a ram-type blowout preventer or an annular blowout preventer in various embodiments. In use, wellbore pressure can act against closing of rams (in ram-type blowout preventers) or packers (in annular blowout preventers). For example, a ram-type blowout preventer often includes opposing rams in a ram cavity that are moved between open and closed positions via connecting rods that connect to and extend from the back of the rams and out of the ram cavity through bonnets. In some instances, the ram-type blowout preventer is hydraulically actuated and the connecting rods are coupled to actuation pistons outside the ram cavity, and the actuation pistons are hydraulically controlled to drive movement of the rams within the ram cavity via the connecting rods. The actuation pistons may be provided in operating chambers on opposite sides of the bonnets from the ram cavity, and seals between the bonnets around the connecting rods can isolate the ram cavity from these operating chambers.

Wellbore pressure in the blowout preventer can act on those portions of the rams and of the connecting rods that are exposed to fluid within the bore and ram cavity of the blowout preventer. In many blowout preventers, connecting rods include buttons on one of their ends, and these buttons are received in mating slots of the rams (e.g., T-shaped slots in the rear faces of the rams) to connect the rams to the connecting rods. In such an arrangement, the connecting rods displace wellbore fluid within the blowout preventer and wellbore pressure on the end face of each connecting rod within the ram cavity (e.g., along the end face of a button of the connecting rod within a mating slot of the ram) can apply a retraction force on the connecting rod that pushes the connecting rod in a direction away from the ram and out of the ram cavity. This retraction force is generally directed opposite the closing direction of the ram that is coupled to the connecting rod and, thus, the retraction force resists closing of the ram. In hydraulically actuated blowout preventers, the ratio of the hydraulic area providing closing force (e.g., at an actuation piston) divided by the hydraulic area resisting closing (e.g., at the end of the connecting rod displacing fluid within the ram cavity) may be referred to as the closing ratio.

In practice, sufficient operating force applied to the ram (via the connecting rod) can both overcome the wellbore-pressure-induced retraction force and be used to create a seal between the ram and an opposing ram when these rams are closed against one another. In some instances, the portion of the operating force used to overcome the retraction force and close the ram (which may be referred to as the closing force) can be approximately three times greater than the portion of the operating force needed to reliably create a seal between the rams (which may be referred to as the sealing force). Actuation assemblies may be sized to provide operating forces that exceed the sum of the closing forces and the sealing forces.

In some embodiments of the present technique, however, ram-type and annular blowout preventers include pressure-balanced operating shafts to facilitate closing of the blowout preventers by reducing forces (e.g., retraction forces) opposing the closing. With respect to ram-type blowout preventers, by avoiding differences in pressure on the opposite ends of operating shafts (also referred to herein as actuation shafts) and differences in pressure on opposite ends of the rams, the closing force for closing a ram can be substantially eliminated (while noting that some closing force would still be applied to overcome friction between the ram and the surface of a ram cavity in which the ram is received). This reduction in the closing force to be overcome can greatly reduce the actuation force needed to operate the blowout preventer. This allows more efficient operation and, in turn, enables use of smaller and lighter actuators.

Figure 3:
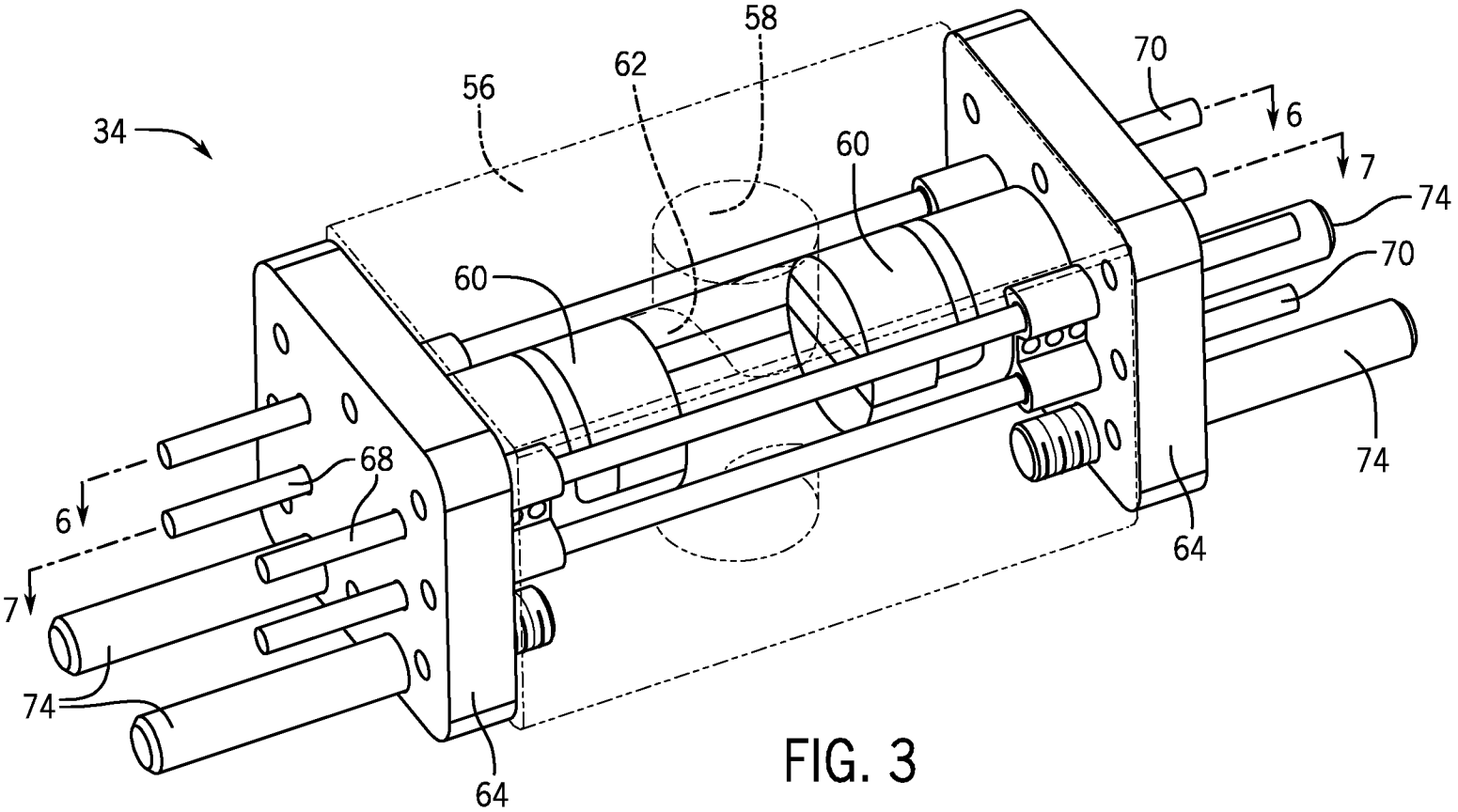
FIG. 3 is a perspective view of a blowout preventer having pressure-balanced actuation shafts for moving rams in accordance with one embodiment.
Figure 4:
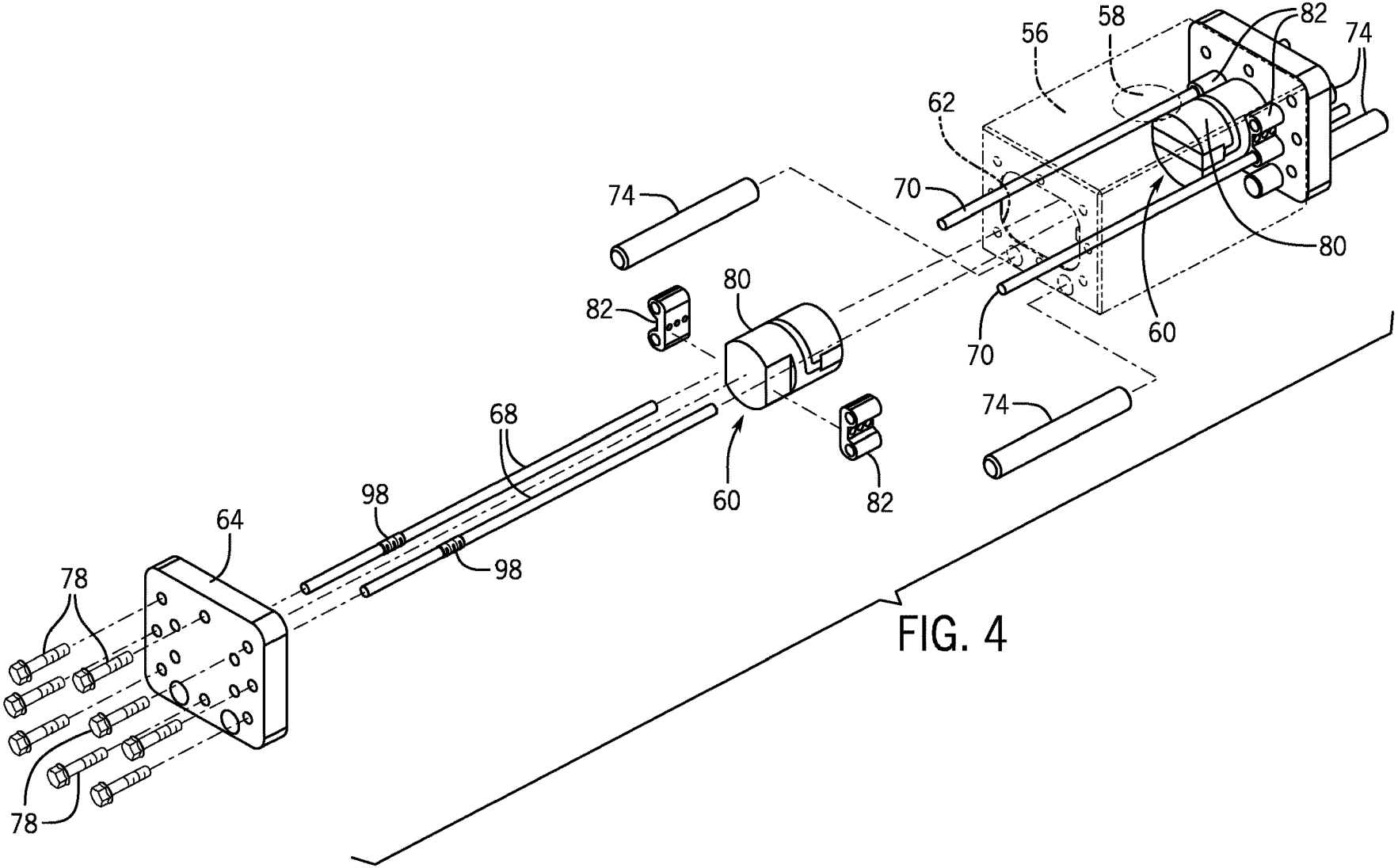
FIG. 4 is an exploded view of the blowout preventer of FIG. 3.

One example of a blowout preventer 34 with pressure-balanced ram assemblies is generally shown in FIGS. 3 and 4. In this depicted embodiment, the blowout preventer 34 includes a hollow main body 56 having a bore 58 that allows fluid or devices (e.g., the drill string 16 or the downhole tool 42) to pass through the blowout preventer 34. The main body 56 is shown in phantom in FIGS. 3 and 4 to show certain internal components of the blowout preventer 34. These internal components include rams 60 positioned within a ram cavity 62 of the main body 56. The rams 60 are diametrically opposed from one another across the bore 58 and can be enclosed within the ram cavity 62 with doors or bonnets 64 of the blowout preventer body, which can be attached to ends of the hollow main body 56.

Rather than having centrally located actuation shafts for moving the rams 60, the blowout preventer 34 includes offset actuation shafts 68 and 70 that extend through the rams 60 and the body of the blowout preventer (i.e., through the bonnets 64 on opposite ends of the hollow main body 56). These shafts 68 and 70 are offset from the centerline of the rams 60 (along the axis of movement of the rams 60 through the ram cavity 62) so that the shafts 68 and 70 do not extend transversely through the bore 58 of the main body 56. The shafts 68 and 70, which may also be referred to as rods, can be used to drive the rams 60 between open positions (as generally shown in FIG. 3) and closed positions in which the opposing rams 60 are closed against one another within the bore 58, as discussed in greater detail below. The depicted blowout preventer 34 also includes bonnet support rods 74 for facilitating installation and removal of the bonnets 64 from the hollow main body 56. As generally shown in FIG. 4, the bonnets 64 can be connected to the main body 56 with fasteners, such as bolts 78. In other embodiments, however, the bonnets 64 can be connected to the main body in some other suitable manner.

In the embodiment shown in FIGS. 3 and 4, each of the shafts 68 and 70 extends through both rams 60, but is only affixed to one of the rams 60. More particularly, in this depicted embodiment, the shafts 68 are connected to drive movement of the ram 60 on the left, while the shafts 70 are connected to drive movement of the ram 60 on the right. In this way, the blowout preventer includes a first ram assembly (i.e., the shafts 68 and the ram 60 connected to the shafts 68) that moves together, and a second ram assembly (i.e., the shafts 70 and the ram 60 connected to the shafts 70) that can move together independent of the first ram assembly. Although the blowout preventer 34 can have four actuation shafts extending through the rams (e.g., as depicted in FIGS. 3 and 4), some other number of actuation shafts may be used for moving rams in other embodiments.

In this depicted embodiment, each of the shafts 68 and 70 also extends through both bonnets 64, so that the ends of the shafts 68 and 70 are positioned outside the pressure-containing main body 56. Seals may be provided along the shafts 68 and 70 at the bonnets 64 to contain pressure and prevent fluid from leaking out of the main body 56 along the shafts 68 and 70. Because both ends of each shaft 68 and 70 are isolated from wellbore pressure within the blowout preventer 34, the wellbore pressure does not act on either end of the shaft to create a retraction force to be overcome during closing of the rams 60. Similarly, as the rams 60 are moved toward the closed position within the main body 56, the rams 60 can also be pressure-balanced. That is, in at least some embodiments pressurized fluid in the main body 56 surrounds the front and rear ends of the rams and the pressurized fluid does not apply a net force on the rams 60 along the axis of movement (i.e., the forces from pressurized fluid in the main body 56 pushing the rams 60 toward the closed position are equal and opposite the forces from that pressurized fluid pushing the rams 60 toward the open position).

The shafts 68 and 70 can be connected to a ram 60 in various manners, but in the embodiment shown in FIGS. 3 and 4 the rams 60 include ram blocks 80 and eye brackets 82 through which the shafts 68 and 70 extend. An example of the ram 60 having such brackets 82 is shown in greater detail in FIG. 5. In addition to the brackets 82, the depicted ram block 80 carries a packer 84 and a top seal 86. The packer 84 facilitates sealing of the bore 58 of the blowout preventer 34 when the ram 60 is moved to the closed position against the opposite ram 60, and the top seal 86 seals against an upper surface of the ram cavity 62. Although generally shown here as a blind sealing ram, the ram 60 could instead be some other type of ram, such as a pipe ram, a wireline ram, or a shear ram, for instance.

The brackets 82 can be coupled to the ram block 80 in any suitable manner. In at least some embodiments, including that depicted in FIG. 5, the brackets 82 include mounting holes 88 for fastening the brackets 82 to the ram block 80 with bolts or other fasteners. In some other instances, the brackets 82 could be clamped or threaded on the ram block 80, or formed integrally with the ram block 80.

Figure 6:
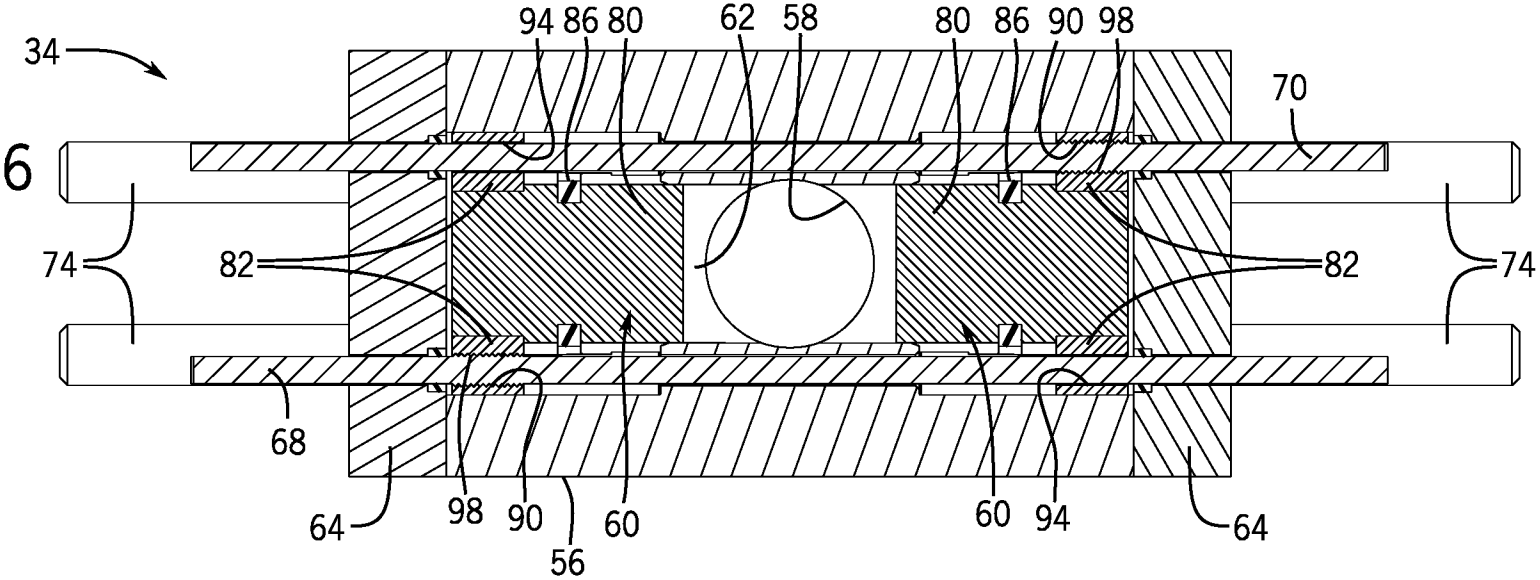
FIGS. 6 and 7 are horizontal cross-sections of the blowout preventer of FIG. 3 and show the actuation shafts extending through the rams and bonnets of the blowout preventer in accordance with one embodiment.
Figure 7:
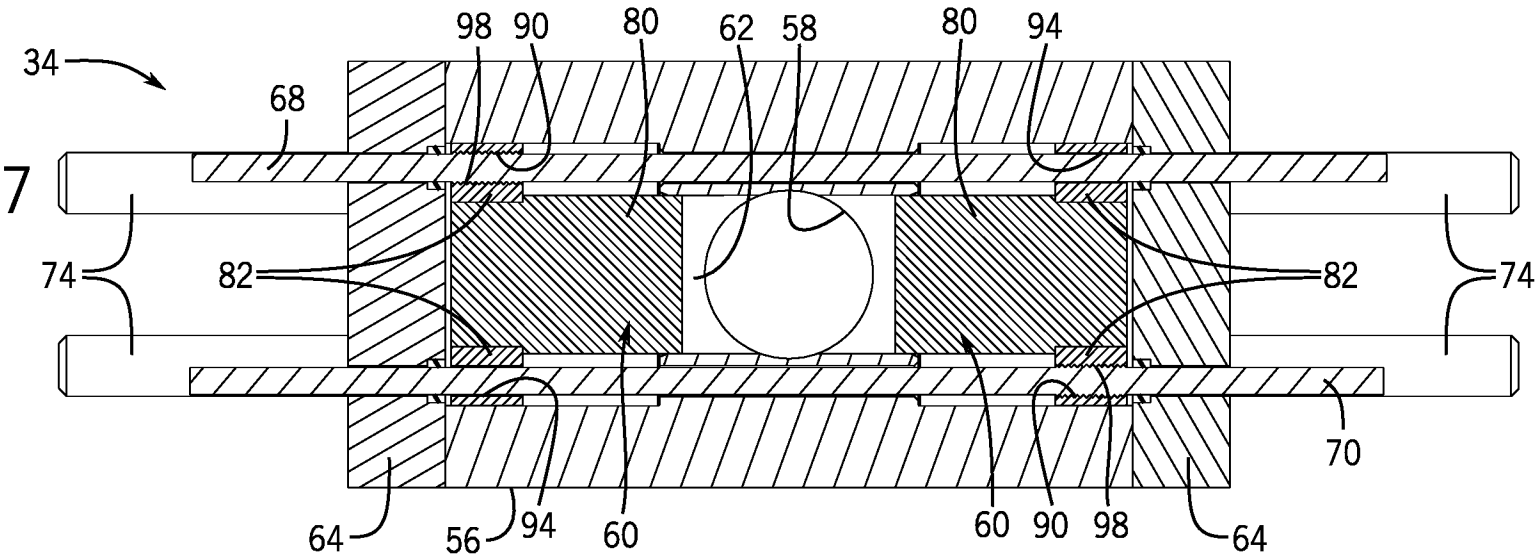

The brackets 82 include threaded holes 90 and unthreaded holes 94. As shown in FIGS. 6 and 7, each of the shafts 68 and 70 extends through a threaded hole 90 of the ram 60 driven by that shaft, through a hole of the main body 56, and through an unthreaded hole 94 of the ram 60 that is not driven by that shaft. Moreover, each shaft 68 and 70 in this depicted embodiment includes a threaded portion 98 that is threaded into the threaded hole 90 of the ram 60 driven by that shaft. This allows movement of each shaft 68 and 70 to drive synchronous movement of the ram 60 to which it is attached via the mating engagement of the threaded portion 98 with the threaded hole 90, while allowing the shaft 68 or 70 to slide through the unthreaded hole 94 of the other ram through which the shaft extends. In this configuration, the shafts 68 can be moved axially to move one of the rams 60 between open and closed positions within the hollow main body 56, while the shafts 70 can be moved axially to move the other ram 60 between its open and closed positions within the main body 56. In other embodiments, the shafts 68 and 70 could be threaded over greater lengths of the shafts and could be rotated to move the rams 60 via the engagement of the mating threads of the shafts 68 and 70 with the threaded holes 90. Each of the shafts 68 and 70 could be driven manually, by an electric actuator, by a hydraulic actuator, or in some other suitable fashion based on the intended application.

Figure 5:
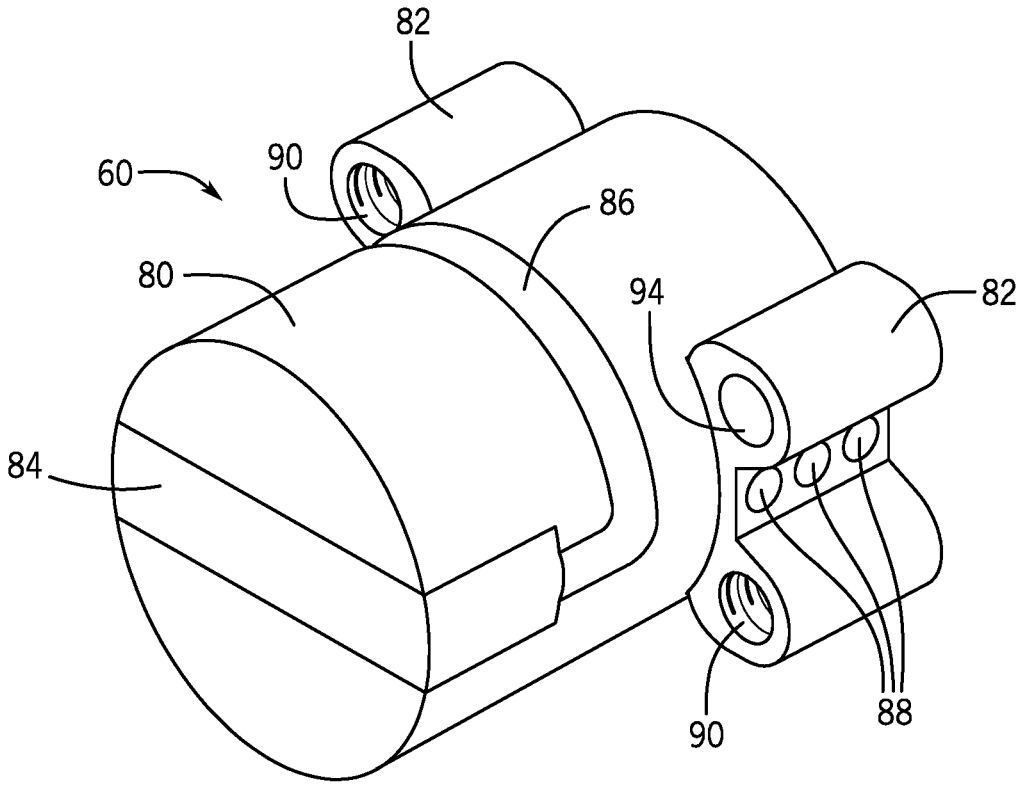
FIG. 5 is a perspective view of a ram of the blowout preventer of FIG. 3.
Figure 8:
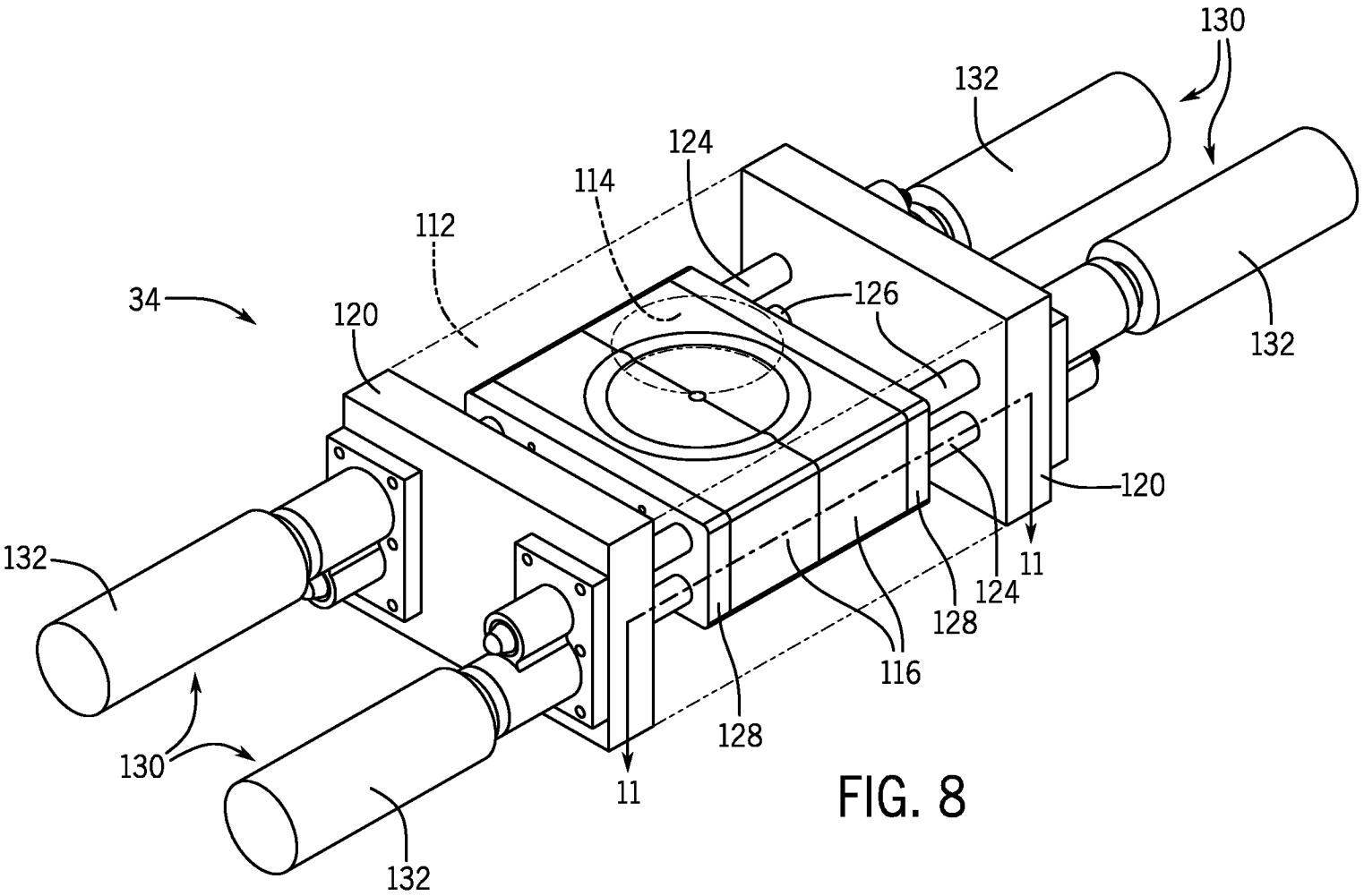
FIG. 8 is a perspective view of a blowout preventer having pressure-balanced actuation shafts for moving rams in accordance with another embodiment.
Figure 9:
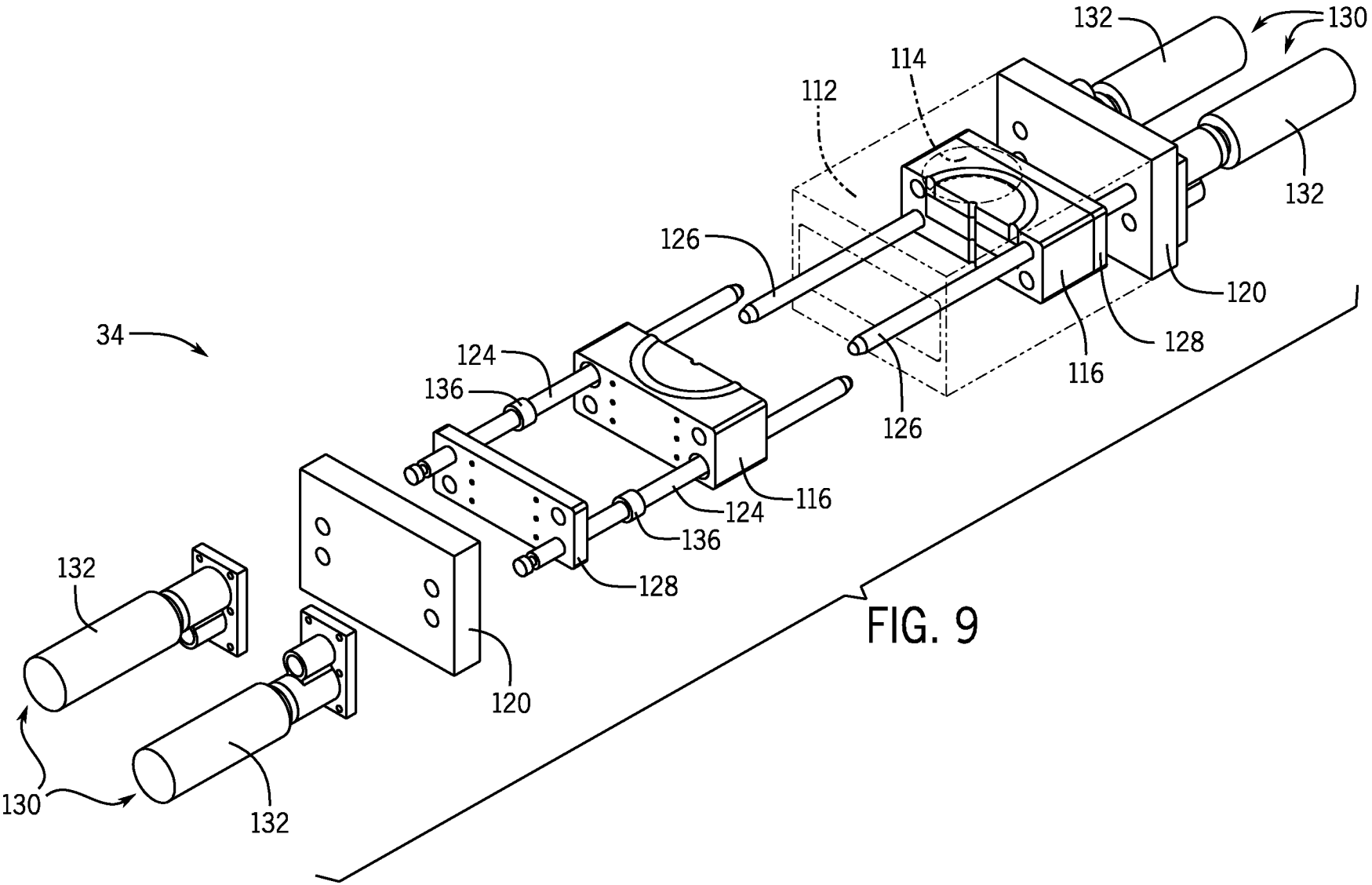
FIG. 9 is an exploded view of the blowout preventer of FIG. 8.

Another example of a blowout preventer 34 having pressure-balanced ram assemblies is depicted in FIGS. 8 and 9. Like that depicted in FIGS. 3 and 4, the blowout preventer 34 in this embodiment includes a hollow main body 112 and a bore 114 that allows fluid or devices to pass through the blowout preventer 34. The main body 112 is provided in phantom in FIGS. 8 and 9 to show rams 116 that are received in a ram cavity of the main body 112. While the rams 60 are depicted in FIGS. 3-5 as round blind rams, the rams 116 are shown in FIGS. 8 and 9 as rectangular wireline rams each having a groove in its front end for receiving a wireline or other cable in the bore 114 through the rams. But it is noted that the rams 60 and the rams 116 could be of any suitable type (e.g., blind ram, wireline ram, pipe ram, shear ram) and shape (e.g., oval rams, rectangular rams, square rams, and circular rams) in other embodiments. The rams 116 are enclosed within the ram cavity with doors or bonnets 120 that can be connected to the main body 112 in any suitable manner.

The blowout preventer 34 of FIGS. 8 and 9 includes offset actuation shafts 124 and 126 that extend through front and rear ends of both the rams 116 and through the bonnets 120. Similar to the actuation shafts 68 and 70 described above, the shafts 124 are connected to drive movement of just one of the rams 116, the shafts 126 are connected to drive movement of the other ram 116, and seals can be used at the bonnets 120 to prevent leaking out of the main body 112 through the bonnets 120 along the shafts. Actuation assemblies 130 are depicted in FIGS. 8 and 9 as including actuators 132 for driving movement of the rams 116 via the shafts 124 and 126. In some embodiments, the actuators 132 are electric actuators, but the shafts 124 and 126 can be actuated in any suitable manner (e.g., hydraulically, electrically, or manually).

Rather than having a threaded connection with the rams 116, each of the shafts 124 and 126 includes an enlarged-diameter portion 136 that is received in a ram 116 so that the shaft 124 or 126 can move the ram 116 via the enlarged portion 136. The enlarged portions 136 can be provided in various forms, such as buttons, collars, or integrally formed portions of the shafts 124 and 126. As depicted in FIG. 9, the rams 116 include retaining plates 128 that can be fastened to ram blocks to capture the enlarged portions 136 within the rams 116.

Figure 10:
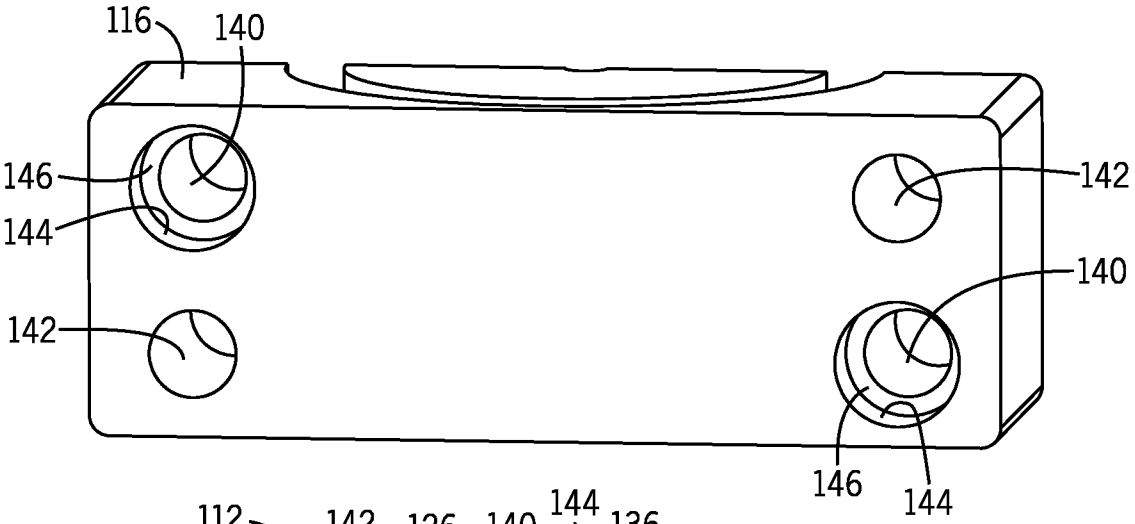
FIG. 10 depicts a ram block of the blowout preventer of FIG. 8 as having holes for receiving actuation shafts extending through the ram block in accordance with one embodiment.
Figure 11:
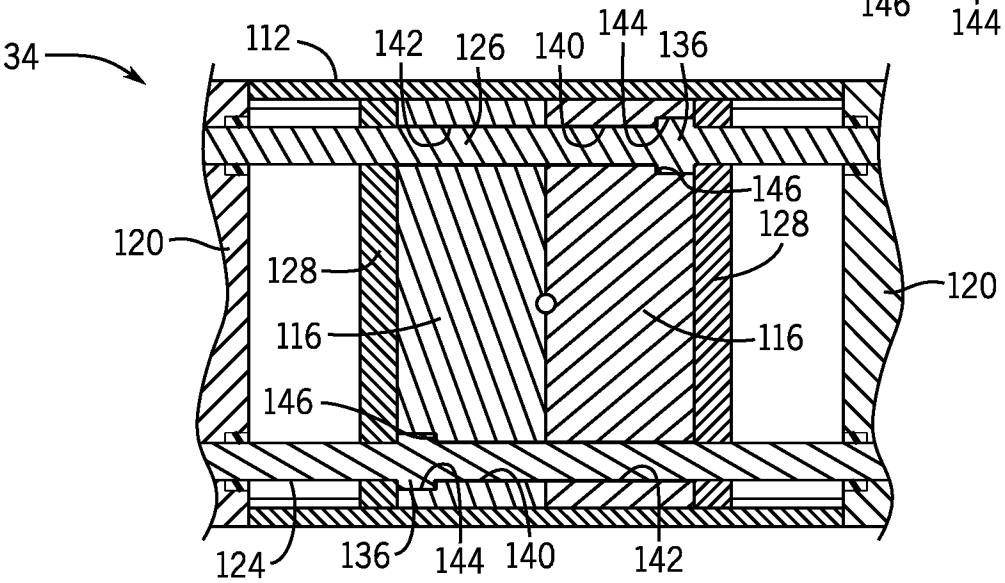
FIG. 11 is a cross-section showing enlarged portions of the actuation shafts captured within the rams of FIG. 8 by retaining plates in accordance with one embodiment.

More particularly, as shown in FIGS. 10 and 11, in at least one embodiment the ram block of each ram 116 includes holes 140 for receiving the enlarged portions 136 of either the shafts 124 or the shafts 126 and holes 142 for allowing the other of the shafts 124 or 126 to pass through the ram 116. The holes 140 include counterbores 144 that receive the enlarged portions 136 of the shafts 124 or 126 that are to drive movement of the ram 116. The retaining plate 128 can be coupled to the ram block to capture the enlarged portions 136 within the counterbores 144. In this arrangement, the actuation shafts 124 (or 126) drive the ram 116 toward the closed position by moving the enlarged portions 136 against shoulders 146 defined by the counterbores 144 and retract the ram 116 toward the open position by moving the enlarged portions 136 against the retaining plate 128.

Figure 12:
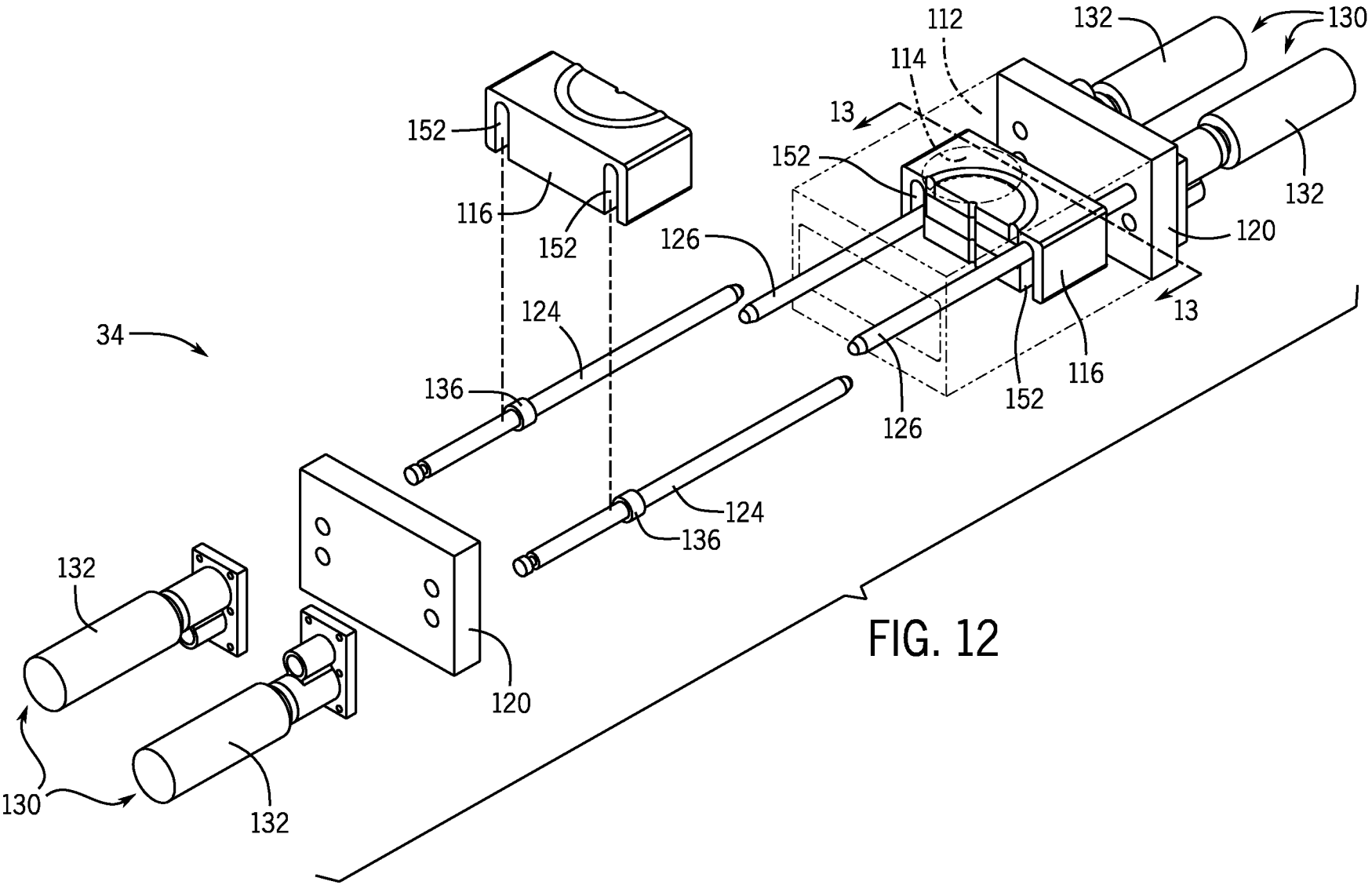
FIG. 12 is an exploded view of a blowout preventer having pressure-balanced actuation shafts and rams with slots for receiving enlarged portions of the actuation shafts in accordance with one embodiment.
Figure 13:
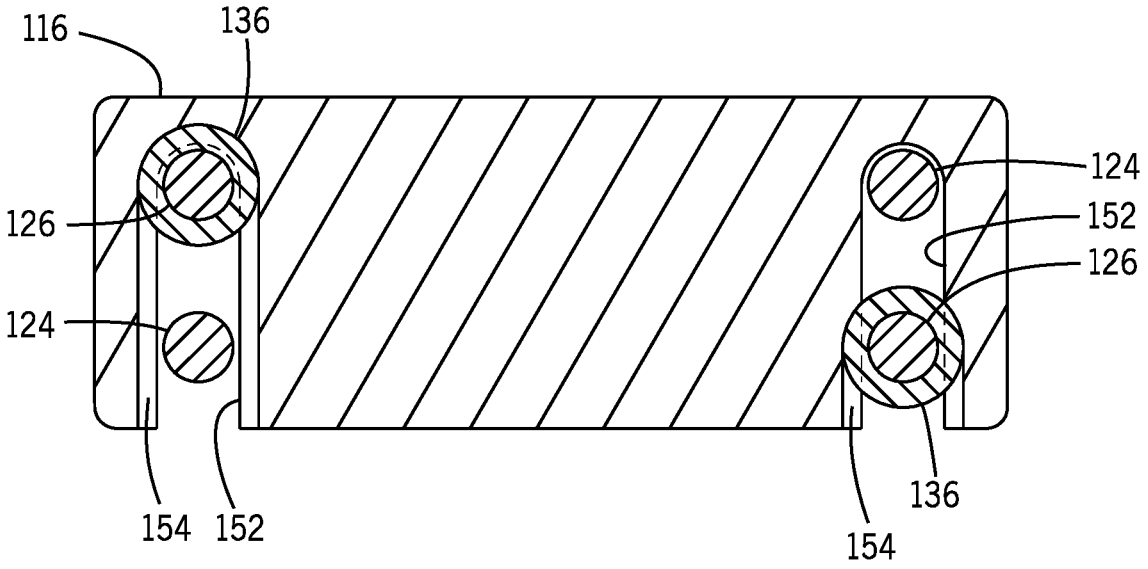
FIG. 13 is a cross-section of a ram of the blowout preventer of FIG. 12 and shows actuation shafts received in the slots of the ram in accordance with one embodiment.

Rather than using retaining plates 128 to capture enlarged portions 136 of shafts 124 and 126 within the counterbores 144, in certain embodiments the rams 116 have slots transverse to the shafts 124 and 126 for receiving the enlarged portions 136. One such embodiment is depicted in FIGS. 12 and 13, in which the rams 116 include vertical transverse slots 152 for receiving the shafts 124 and 126. As generally shown in FIG. 13 for one of the rams 116, the slots 152 are wide enough to receive each of the shafts 124 and 126 extending through the ram 116, and portions of these slots 152 are recessed to receive the enlarged portions 136 of the shafts 126. For the other ram 116 of FIG. 12, the recessed portions of the slots 152 receive the enlarged portions 136 of the shafts 124. The recessed portions of the slots 152 define lateral shoulders 154 that capture the enlarged portions 136 in a manner like that depicted in FIG. 11. The shafts 124 and 126 move the rams 116 toward the closed position by moving the captured enlarged portions 136 against the lateral shoulders 154 positioned in front of the enlarged portions 136 (i.e., the lateral shoulders 154 positioned between the captured enlarged portions 136 and the bore 114) and toward the open position by moving the captured enlarged portions 136 against the lateral shoulders 154 positioned behind the enlarged portions 136 (i.e., lateral shoulders 154 positioned between the enlarged portions 136 and the bonnets 120).

Figure 14:
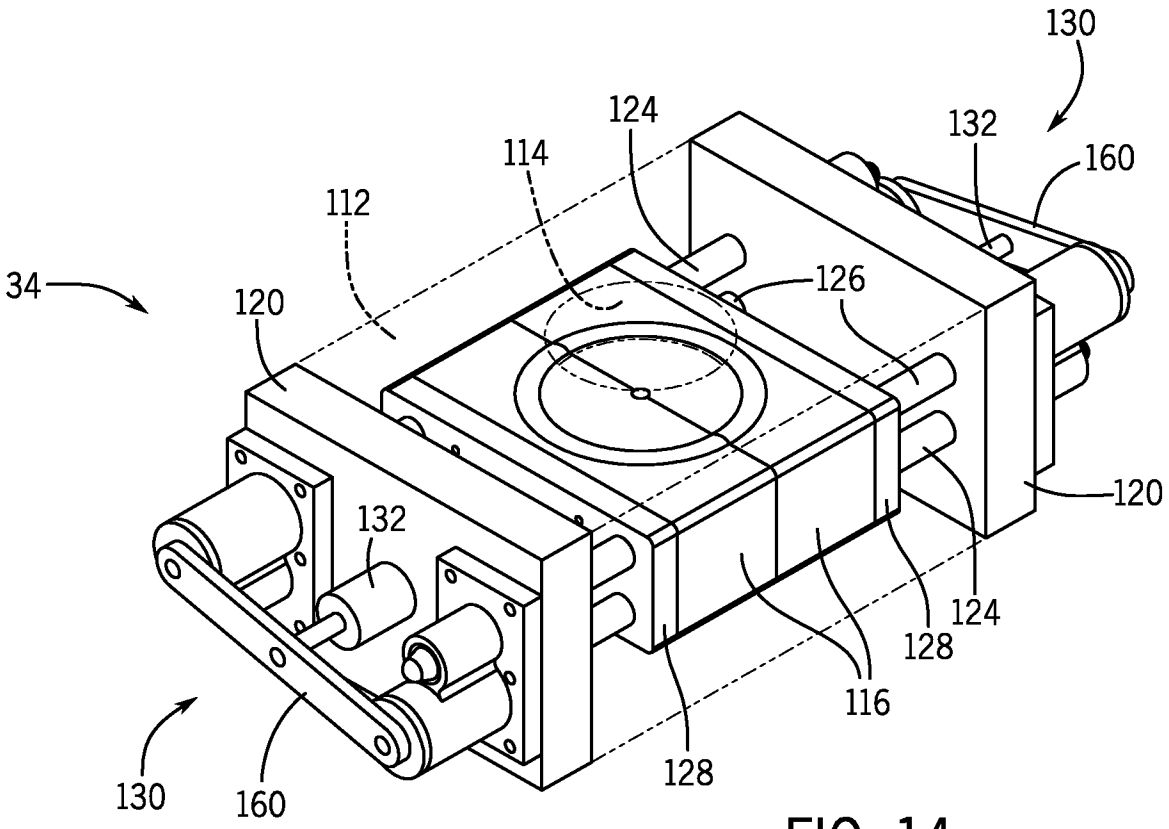
FIG. 14 shows a blowout preventer with pressure-balanced actuation shafts operated by a pair of actuators on opposite sides of the blowout preventer in accordance with one embodiment.
Figure 15:
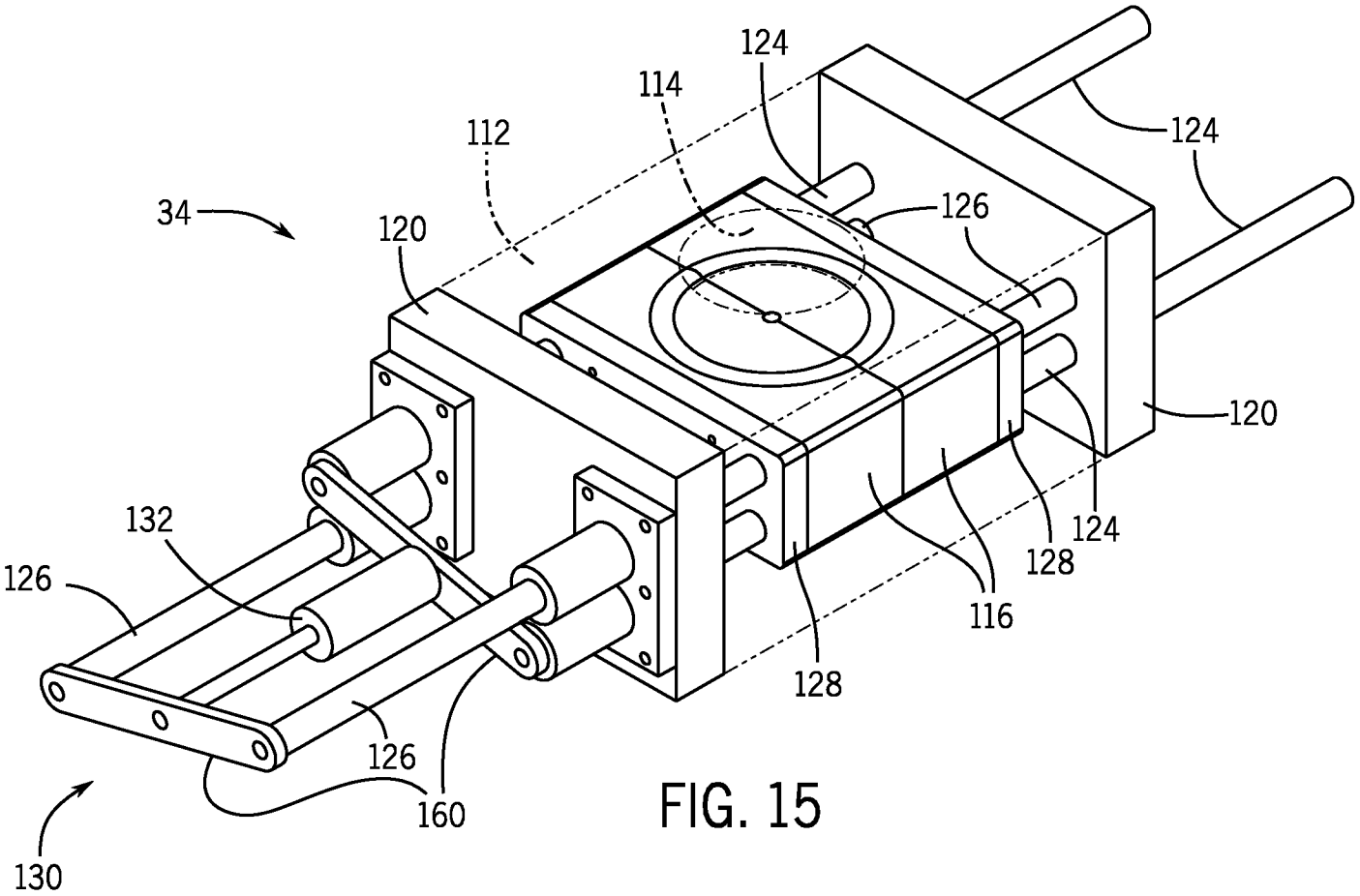
FIG. 15 shows a blowout preventer with pressure-balanced actuation shafts operated by an actuator on one side of the blowout preventer in accordance with one embodiment.

In some embodiments, each pressure-balanced actuation shaft (e.g., shaft 68, 70, 124, or 126) of a blowout preventer can be driven by an actuator 132 dedicated to moving only that one shaft. In other embodiments, however, the number of actuators 132 for moving the actuation shafts can be less than the number of actuation shafts to be moved. For instance, as depicted in FIG. 14, the blowout preventer 34 can include a single actuator 132 on each end for moving multiple actuation shafts. More specifically, as shown in FIG. 14, the shafts 124 are connected on one end of the blowout preventer 34 with a synchronization plate 160, and the shafts 126 are connected on the opposite end of the blowout preventer 34 with another synchronization plate 160. One actuator 132 controls movement of both actuation shafts 124 via the synchronization plate 160 connecting the shafts 124, while another actuator 132 controls movement of both actuation shafts 126 via the other synchronization plate 160. In still other embodiments, one or more actuators are used on only a single side of the blowout preventer 34 for controlling the actuation shafts. As generally illustrated in FIG. 15, for example, the synchronization plates 160 may be positioned on the same side of the blowout preventer 34 and a single actuator 132 (or multiple actuators 132) can be positioned between the synchronization plates 160 to push one pair of actuation shafts and pull the other pair of actuation shafts.

The blowout preventers 34 can be mounted as part of a wellhead assembly in any suitable manner. For instance, the main bodies of the blowout preventers 34 can include studs or connection flanges to facilitate connection of the blowout preventers to other components. And while some blowout preventers 34 may have a single pair of rams, it will be appreciated that the present techniques using pressure-balanced actuation shafts may be applied to other blowout preventers, including annular blowout preventers and ram-type blowout preventers having multiple pairs of rams.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An apparatus comprising:

a blowout preventer including:

a hollow body having a bore and a ram cavity;

a pair of opposing rams disposed in the ram cavity; and a shaft that extends through both rams of the pair of opposing rams and is connected to a first ram of the pair of opposing rams such that movement of the shaft during operation of the blowout preventer causes movement of the first ram with the shaft.

2. The apparatus of claim 1, wherein the shaft extends through a second ram of the pair of opposing rams such that movement of the shaft during operation of the blowout preventer does not cause movement of the second ram with the shaft.

3. The apparatus of claim 2, comprising an additional shaft that extends through the first and second rams.

4. The apparatus of claim 3, wherein the additional shaft is connected to the second ram such that movement of the additional shaft during operation of the blowout preventer causes movement of the second ram with the additional shaft, and the additional shaft extends through the first ram such that movement of the additional shaft during operation of the blowout preventer does not cause movement of the first ram with the additional shaft.

5. The apparatus of claim 1, wherein each ram of the pair of opposing rams includes an eye bracket fastened to a ram block, and the shaft extends through the eye bracket of each ram.

6. The apparatus of claim 5, wherein the shaft also extends through a hole in the hollow body that is positioned between the eye brackets of the pair of opposing rams through which the shaft extends.

7. The apparatus of claim 1, wherein each ram of the pair of opposing rams includes a ram block and the shaft extends through the ram block of each ram.

8. The apparatus of claim 7, wherein the shaft includes a shaft portion with an enlarged diameter configured to engage one ram of the pair of opposing rams so as to drive movement of the one ram upon movement of the shaft.

9. The apparatus of claim 8, comprising a retaining plate fastened to the ram block of the one ram so as to capture the shaft portion with the enlarged diameter between the retaining plate and the ram block of the one ram.

10. The apparatus of claim 1, comprising a wellhead assembly including the blowout preventer.

11. The apparatus of claim 10, wherein the blowout preventer is installed in the wellhead assembly as a wireline valve.

12. An apparatus comprising:

a hollow body having a bore; and a ram assembly including:

a ram disposed within a ram cavity of the hollow body such that the ram can be moved within the ram cavity along an axis from an open position to a closed position to selectively impede flow of a fluid through the bore of the hollow body; and an actuation shaft coupled to the ram such that movement of the actuation shaft during operation of the blowout preventer causes movement of the ram with the shaft;

wherein the ram assembly is pressure-balanced in that, as the ram is moved toward the closed position during operation and is exposed to the fluid, the fluid surrounds a front end and a rear end of the ram and the pressure of the fluid does not apply a net force on the ram or the actuation shaft along the axis; and wherein the actuation shaft extends through the front and rear ends of the ram.

13. The apparatus of claim 12, comprising an additional ram positioned in the hollow body on an opposite side of the bore from the ram, wherein the actuation shaft also extends through the additional ram.

14. The apparatus of claim 12, comprising a blowout preventer having the hollow body and the ram.

15. A method comprising:

receiving a pressurized fluid in a bore of a blowout preventer;

closing a ram of the blowout preventer, wherein closing the ram of the blowout preventer includes moving the ram by moving an actuation shaft that extends through opposite ends of the ram and also through an additional ram diametrically opposed to the ram across the bore wherein the additional ram is not connected to move with the actuation shaft and sliding the actuation shaft through the additional ram while moving the ram via the actuation shaft.

16. The method of claim 15, comprising closing the additional ram of the blowout preventer, wherein closing the additional ram of the blowout preventer includes moving the additional ram by moving an additional actuation shaft that extends through both the ram and the additional ram, and the ram is not connected to move with the additional actuation shaft.

* * * * *